US005730272A

United States Patent [19]

Dobbins et al.

[11] Patent Number: 5,730,272

[45] **Date of Patent: *Mar. 24, 1998**

[54] METHOD FOR IMPROVED COIN, BILL AND OTHER CURRENCY ACCEPTANCE AND SLUG OR COUNTERFEIT REJECTION

[75] Inventors: Bob M. Dobbins, Villanova; Jeffrey E. Vaks, Chester Springs, both of Pa.

[73] Assignee: Mars Incorporated, McLean, Va.

[ * ] Notice: The term of this patent shall not extend beyond the expiration date of Pat. No. 5,167,313.

[21] Appl. No.: 717,698

[22] Filed: Sep. 23, 1996

Related U.S. Application Data

[63] Continuation of Ser. No. 457,618, Jun. 1, 1995, Pat. No. 5,564,548, which is a continuation of Ser. No. 249,323, May 26, 1994, Pat. No. 5,443,144, which is a continuation of Ser. No. 898,802, Jun. 15, 1992, Pat. No. 5,330,041, which is a continuation of Ser. No. 595,076, Oct. 10, 1990, Pat. No. 5,167,313.

[51] Int. Cl.[6] ..... G07D 5/08

[52] U.S. Cl. ..... 194/317

[58] Field of Search ..... 194/317, 318, 194/319; 324/202, 225, 227

[56] References Cited

U.S. PATENT DOCUMENTS

| | | | |
|---|---|---|---|
| 3,918,564 | 11/1975 | Heiman et al. | 194/318 |
| 3,918,565 | 11/1975 | Fougere et al. | 194/317 |
| 4,464,787 | 8/1984 | Fish et al. . | |
| 4,538,719 | 9/1985 | Gray et al. | 194/317 |
| 4,546,869 | 10/1985 | Dean et al. . | |
| 4,556,140 | 12/1985 | Okada . | |
| 4,572,349 | 2/1986 | Furuya et al. . | |
| 4,660,705 | 4/1987 | Kai et al. . | |
| 4,749,074 | 6/1988 | Ueki et al. | 194/317 |
| 4,754,862 | 7/1988 | Rawitz-Swerbo et al. | 194/317 X |
| 4,951,799 | 8/1990 | Kai | 194/317 |
| 5,007,520 | 4/1991 | Harris et al. | 194/317 |
| 5,167,313 | 12/1992 | Dobbins et al. | 194/317 |

FOREIGN PATENT DOCUMENTS

| | | | |
|---|---|---|---|
| 0155126 | 9/1985 | European Pat. Off. . | |
| 0367921 | 5/1990 | European Pat. Off. . | |
| 0384375 | 8/1990 | European Pat. Off. . | |
| 2646025 | 4/1978 | Germany . | |
| 1405937 | 9/1975 | United Kingdom . | |
| 2062854 | 5/1981 | United Kingdom . | |
| 2205430 | 12/1988 | United Kingdom . | |
| 2238152 | 5/1991 | United Kingdom . | |
| WO 85/04037 | 9/1985 | WIPO | 194/317 |

*Primary Examiner*—F. J. Bartuska
*Attorney, Agent, or Firm*—Fish & Richardson P.C.

[57] ABSTRACT

Methods and validation apparatus for achieving improved acceptance and rejection for coins, bills and other currency items. One aspect includes modifying item acceptance criteria by creating and defining three-dimensional acceptance clusters, the data for which are stored in look-up tables in memory associated with a microprocessor. A second aspect involves fraud prevention by temporarily tightening or readjusting item acceptance criteria when a potential fraud attempt is detected. A third aspect relates to minimizing the effects of counterfeit items such as slugs on the self-adjustment process for the item acceptance criteria. A final aspect relates to calculation of a relative value of the acceptance criteria in order to conserve memory space and minimize computation time.

7 Claims, 10 Drawing Sheets

METHOD FOR IMPROVED COIN, BILL AND OTHER CURRENCY ACCEPTANCE AND SLUG OR COUNTERFEIT REJECTION

This is a continuation of application Ser. No. 08/457,618 filed on Jun. 1, 1995, now U.S. Pat. No. 5,564,548, which is a continuation of Ser. No. 249,323, filed May 26, 1994, now U.S. Pat. No. 5,443,144, which is a continuation of Ser. No. 898,802, filed Jun. 15, 1992, now U.S. Pat. No. 5,330,041, which is a continuation of Ser. No. 595,076, filed Oct. 10, 1990, now U.S. Pat. No. 5,167,313.

TECHNICAL FIELD

The present invention relates to the examination of coins, bills or other currency for purposes such as determining their authenticity and denomination, and more particularly to methods and apparatus for achieving a high level of acceptance of valid coins or currency while simultaneously maintaining a high level of rejection of nonvalid coins or currency, such as slugs or counterfeits. While the present invention is applicable to testing of coins, bills and other currency, for the sake of simplicity, the exemplary discussion which follows is primarily in terms of coins. The application of the present invention to the testing of paper money, banknotes and other currency will be immediately apparent to one of ordinary skill in the art.

BACKGROUND ART

It has long been recognized in the field of coin and currency testing that a balance must be struck between the conflicting goals of "acceptance" and "rejection"—perfect acceptance being the ability to correctly identify and accept all genuine items no matter their condition, and perfect rejection being the ability to correctly discriminate and reject all non-genuine items. When testing under ideal conditions, no difficulty arises when trying to separate ideal or perfect coins from slugs or counterfeit coins that have different characteristics even if those differences are relatively slight. Data identifying the characteristics of the ideal coins can be stored and compared with data measured from a coin or slug to be tested. By narrowly defining coin acceptance criteria, valid coins that produce data falling within these criteria can be accepted and slugs that produce data falling outside these criteria can be rejected. A well-known method for coin acceptance and slug rejection is the use of coin acceptance windows to define criteria for the coin acceptance. One example of the use of such windows is described in U.S. Pat. Nos. 3,918,564 and 3,918,565, both assigned to the assignee of the present invention.

Of course, in reality, neither the test conditions nor the coins to be tested are ideal. Windows or other tests must be set up to accept a range of characteristic coin data for worn or damaged genuine coins, and also to compensate for environmental conditions such as extreme heat, extreme cold, humidity and the like. As the acceptance windows or other coin testing criteria are widened or loosened, it becomes more and more likely that a slug or counterfeit coin will be mistakenly accepted as genuine. As test criteria are narrowed or tightened, it becomes more likely that a genuine coin will be rejected.

U.K. Application Serial No. 89/23456.1 filed Oct. 18, 1989, and assigned to the assignee of the present invention, is one response to the real world compromise between achieving adequately high levels of acceptance and rejection at the same time. This U.K. application describes techniques for establishing non-uniform windows that maintain a high level of acceptance while achieving a high level of rejection.

Another prior art approach is found in the Mars Electronics IntelliTrac™ Series products. The IntelliTrac™ Series products operate substantially as described in European Patent Application EP 0 155 126, which is assigned to the assignee of the present invention.

SUMMARY OF THE INVENTION

The present invention relates to simple and cost effective methods and apparatus for achieving improved acceptance and rejection. One aspect of this invention relates to improvements in maintaining an acceptably high level of coin acceptance while achieving a much improved level of slug rejection by substantially modifying the configuration of the coin acceptance criteria. A second aspect relates to fraud prevention by temporarily tightening or readjusting the coin acceptance criteria when a potential fraud attempt is detected. A third aspect relates to minimizing the effects of counterfeit coins and slugs on the self-adjustment process for a coin acceptance window while automatically adjusting to compensate for changing environmental conditions. A fourth aspect of the present invention relates to conserving memory space and minimizing computation time in a microprocessor-based coin validation system. Other aspects of the present invention will be clear from the detailed specification which follows.

The present invention can be applied to a wide range of electronic tests for measuring one or more parameters indicative of the acceptability of a coin, currency or the like. The various aspects of the invention may be employed separately or in conjunction depending upon the desired application.

DETAILED DESCRIPTION

The coin examining apparatus and methods of this invention may be applied to a wide range of electronic coin tests for measuring a parameter indicative of a coin's acceptability and to the identification and acceptance of any number of coins from the coin sets of many countries. In particular, the following description concentrates on the details for setting the acceptance limits for particular tests for particular coins, but the application of the invention to other coin tests and other coins will be clear to those skilled in the art.

The figures are intended to be representational and are not drawn to scale. Throughout this specification, the term "coin" is intended to include genuine coins, tokens, counterfeit coins, slugs, washers, and any other item which may be used by persons in an attempt to use coin-operated devices. Also, the disclosed invention may suitably be applied to validation of bills and other currency, as well as coins. It will be appreciated that the present invention is widely applicable to coin, bill and other currency testing apparatus generally.

The presently preferred embodiment of the method and apparatus of this invention is implemented as a modification of an existing family of coin validators, the Mars Electronics IntelliTrac™ Series. The present invention employs a revised control program and revised control data. The IntelliTrac™ Series operates substantially as described in European Application EP 0 155 126. That European Application is assigned to the assignee of the present invention, and is incorporated by reference herein.

Figure 1:
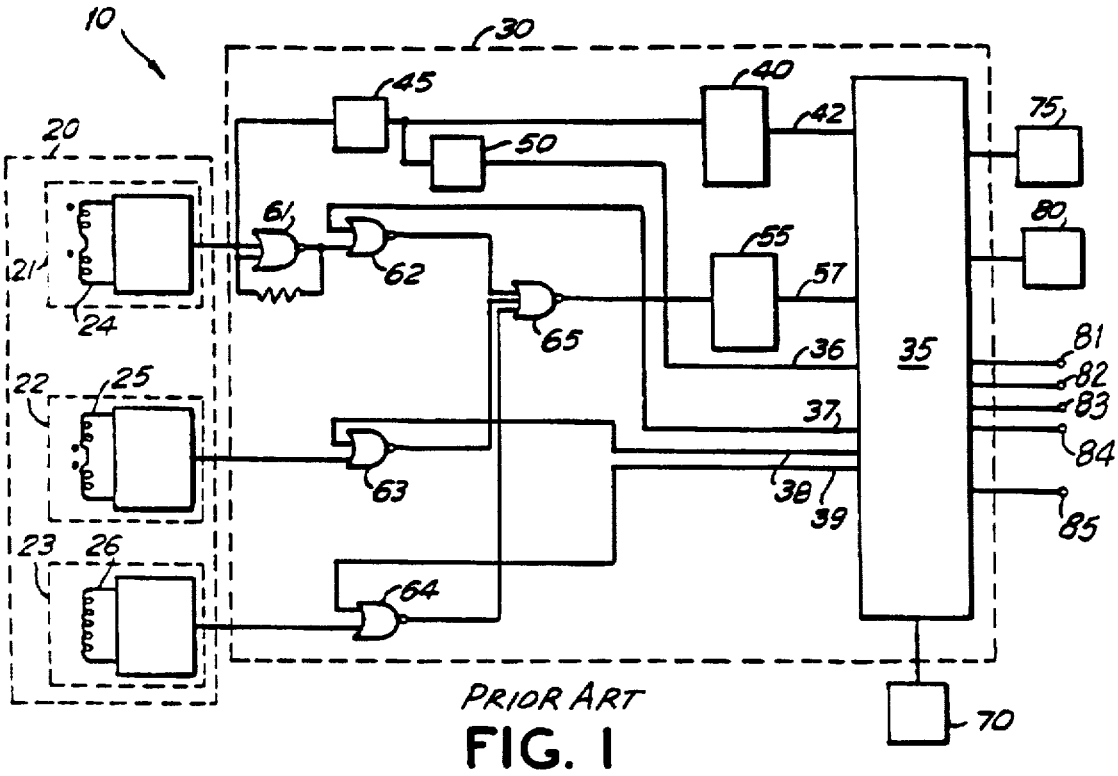
PRIOR ART FIG. 1
FIG. 1 is a schematic block diagram of an embodiment of electronic coin testing apparatus, including sensors, suitable for use with the invention.
Figure 2:
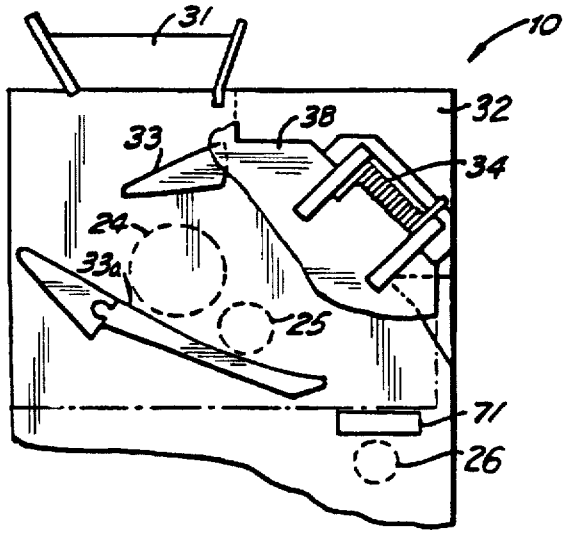
FIG. 2 is a schematic diagram indicating suitable positions for the sensors of the embodiment of FIG. 1.

FIG. 1 shows a block schematic diagram of a prior art electronic coin testing apparatus 10 suitable for implementing the method and apparatus of the present invention by making the modifications described below. The mechanical portion of the electronic coin testing apparatus 10 is shown in FIG. 2. The electronic coin testing apparatus 10 includes two principal sections: a coin examining and sensing circuit 20 including individual sensor circuits 21, 22 and 23, and a processing and control circuit 30. The processing and control circuit 30 includes a programmed microprocessor 35, an analog to digital (A/D) converter circuit 40, a signal shaping circuit 45, a comparator circuit 50, a counter 55, and NOR-gates 61, 62, 63, 64 and 65.

Each of the sensor circuits 21, 22 includes a two-sided inductive sensor 24, 25 having its series-connected coils located adjacent opposing sidewalls of a coin passageway. As shown in FIG. 2, sensor 24 is preferably of a large diameter for testing coins of wideranging diameters. Sensor circuit 23 includes an inductive sensor 26 which is preferably arranged as shown in FIG. 2.

Sensor circuit 21 is a high-frequency, low-power oscillator used to test coin parameters, such as diameter and material. As a coin passes the sensor 24, the frequency and amplitude of the output of sensor circuit 21 change as a result of coin interaction with the sensor 24. This output is shaped by the shaping circuit 45 and fed to the comparator circuit 50. When the change in the amplitude of the signal from shaping circuit 45 exceeds a predetermined amount, the comparator circuit 50 produces an output on line 36 which is connected to the interrupt pin of microprocessor 35.

The output from shaping circuit 45 is also fed to an input of the A/D converter circuit 40 which converts the analog signal at its input to a digital output. This digital output is serially fed on line 42 to the microprocessor 35. The digital output is monitored by microprocessor 35 to detect the effect of a passing coin on the amplitude of the output of sensor circuit 21. In conjunction with frequency shift information, the amplitude information provides the microprocessor 35 with adequate data for particularly reliable testing of coins of wideranging diameters and materials using a single sensor 21.

The output of sensor circuit 21 is also connected to one input of NOR gate 61 the output of which is in turn connected to an input of NOR gate 62. NOR gate 62 is connected as one input of NOR gate 65 which has its output connected to the counter 55. Frequency related information for the sensor circuit 21 is generated by selectively connecting the output of sensor circuit 21 through the NOR gates 61, 62 and 65 to the counter 55. Frequency information for sensor circuits 22 and 23 is similarly generated by selectively connecting the output of either sensor circuit 22 or 23 through its respective NOR gate 63 or 64 and the NOR gate 65 to the counter 55. Sensor circuit 22 is also a high-frequency, low-power oscillator and it is used to test coin thickness. Sensor circuit 23 is a strobe sensor commonly found in vending machines. As shown in FIG. 2, the sensor 26 is located after an accept gate 71. The output of sensor circuit 23 is used to control such functions as the granting of credit, to detect coin jams and to prevent customer fraud by methods such as lowering an acceptable coin into the machine with a string.

The microprocessor 35 controls the selective connection of the outputs from the sensor circuits 21, 22 and 23 to counter 55 as described below. The frequency of the oscillation at the output of the sensor circuits 21, 22 and 23 is sampled by counting the threshold level crossings of the output signal occurring in a predetermined sample time. The counting is done by the counter circuit 55 and the length of the predetermined sample time is controlled by the microprocessor 35. One input of each of the NOR gates 62, 63 and 64 is connected to the output of its associated sensor circuit 21, 22 and 23. The output of sensor 21 is connected through the NOR gate 61 which is connected as an inverter amplifier. The other input of each of the NOR gates 62, 63 and 64 is connected to its respective control line 37, 38 and 39 from the microprocessor 35. The signals on the control lines 37, 38 and 39 control when each of the sensor circuits 21, 22 and 23 is interrogated or sampled, or in other words, when the outputs of the sensor circuits 21, 22 and 23 will be fed to the counter 55. For example, if microprocessor 35 produces a high (logic "1") signal on lines 38 and 39 and a low signal (logic "0") on line 37, sensor circuit 21 is interrogated, and each time the output of the NOR gate 61 goes low, the NOR gate 62 produces a high output which is fed through NOR gate 65 to the counting input of counter 55. Counter 55 produces an output count signal and this output of counter 55 is connected by line 57 to the microprocessor 35. Microprocessor 35 determines whether the output count signal from the counter 55 and the digital amplitude information from A/D converter circuit 40 are indicative of a coin of acceptable diameter and material by determining whether the outputs of counter 55 and A/D converter circuit 40 or a value or values computed therefrom are within stored acceptance limits. When sensor circuit 22 is interrogated, microprocessor 35 determines whether the counter output is indicative of a coin of acceptable thickness. Finally, when sensor circuit 23 is interrogated, microprocessor 35 determines whether the counter output is indicative of coin presence or absence. When both the diameter and thickness tests are satisfied, a high degree of accuracy in discrimination between genuine and false coins is achieved.

A person skilled in the art would readily be able to implement in any number of ways the specific logic circuits for the block diagram set forth in FIG. 1 and described above. Preferably, the circuitry suitable for the embodiment of FIG. 1 is incorporated in an application specific integrated circuit (ASIC) of the type presently part of the TA100 stand alone acceptor sold by Mars Electronics, a subsidiary of the assignee of the present invention. Another specific way to implement the circuitry of FIG. 1 is shown and described in European Patent Application EP 0 155 126, referenced above, which is assigned to the assignee of the present invention, and which is incorporated herein by reference.

The methods of the present invention will now be described in the context of setting coin acceptance limits based upon the frequency information from sensor circuit 21. As a coin approaches and passes inductive sensor 24, the frequency of its associated oscillator varies from the no coin idling frequency, $f_0$, and the output of sensor circuit 21 varies accordingly. Also, the amplitude of the envelope of this output signal varies. Microprocessor 35 then computes a maximum change in frequency $\Delta f$, where $\Delta f$ equals the maximum absolute difference between the frequency measured during coin passage and the idling frequency. The $\Delta f$ value is also sometimes referred to as the shift value. $\Delta f=\max(f_{measured}-f_0)$. A dimensionless quantity $F=\Delta f/f_0$ is then computed and compared with stored acceptance limits to see if this value of F for the coin being tested lies within the acceptability range for a valid coin. The F value is also sometimes referred to as the relative value.

As background to such measurements and computations, see U.S. Pat. No. 3,918,564 assigned to the assignee of the present application. As discussed in that patent, this type of measurement technique also applies to parameters of a sensor output signal other than frequency, for example, amplitude. Similarly, while the present invention is specifically applied to the setting of coin acceptance limits for particular sensors providing amplitude and frequency outputs, it applies in general to the setting of coin acceptance limits derived from a statistical function for a number of previously accepted coins of the parameter or parameters measured by any sensor.

In the prior art, if the coin was determined to be acceptable, the F value was stored and added to the store of information used by microprocessor 35 for computing new acceptance limits. For example, a running average of stored F values was computed for a predetermined number of previously accepted coins and the acceptance limits were established as the running average plus or minus a stored constant or a stored percentage of the running average. Preferably, both wide and narrow acceptance limits were stored in the microprocessor 35. Alternatively these limits could be stored in RAM or ROM. In the embodiment shown, whether the new acceptance limits were set to wide or narrow values was controlled by external information supplied to the microprocessor through its data communication bus. Alternatively, a selection switch connected to one input of the microprocessor 35 could be used. In the latter arrangement, microprocessor 35 tested for the state of the switch, that is, whether it was open or closed and adjusted the limits depending on the state of the switch. The narrow range achieved very good protection against the acceptance of slugs; however, the tradeoff was that acceptable coins which were worn or damaged were likely to be rejected. The ability to select between wide and narrow acceptance limits allowed the owner of the apparatus to adjust the acceptance limits in accordance with his operational experience. As described further below in conjunction with a discussion of FIGS. 4 and 5, the present invention has an improved and more sophisticated approach to the acceptance/rejection tradeoff.

Other ports of the microprocessor 35 are connected to a relay control circuit 70 for controlling the gate 71 shown in FIG. 2, a clock 75, a power supply circuit 80, interface lines 81, 82, 83 and 84, and debug line 85. The microprocessor 35 can be readily programmed to control relay circuit 70 which operates a gate to separate acceptable from unacceptable coins or perform other coin routing tasks. The particular details of controlling such a gate do not form a part of the present invention.

The clock 75 and power supply 80 supply clock and power inputs required by the microprocessor 35. The interface lines 81, 82, 83 and 84 provide a means for connecting the electronic coin testing apparatus 10 to other apparatus or circuitry which may be included in a coin operated vending mechanism which includes the electronic coin testing apparatus 10. The details of such further apparatus and the connection thereto do not form part of the present invention. Debug line 85 provides a test connection for monitoring operation and debugging purposes.

FIG. 2 illustrates the mechanical portion of the coin testing apparatus 10 and one way in which sensors 24, 25 and 26 may be suitably positioned adjacent a coin passageway defined by two spaced side walls 32, 38 and a coin track 33, **33*a*. The coin handling apparatus includes a conventional coin receiving cup 31, two spaced sidewalls 32 and 38, connected by a conventional hinge and spring assembly 34, and coin track 33, 33*a*. The coin track 33, 33*a* and sidewalls 32, 38 form a coin passageway from the coin entry cup 31 past the coin sensors 24, 25. FIG. 2 also shows the sensor 26 located after the gate 71, which in FIG. 2** is shown for separating acceptable from unacceptable coins.

It should be understood that other positioning of sensors may be advantageous, that other coin passageway arrangements are contemplated and that additional sensors for other coin tests may be used.

The various aspects of the present invention will now be described.

COIN CLUSTERS—IMPROVED DEFINITION OF COIN ACCEPTANCE CRITERIA

When validating coins, two or more independent tests on a coin are typically performed, and the coin is deemed authentic or of a specific denomination or type only if all the test results equal or come close to the results expected for a coin of that denomination. For example, the influence of a coin on the fields generated by two or more sensors can be compared to measurements known for authentic coins corresponding to thickness, diameter and material content. This is represented graphically in FIG. 3, in which each of the three orthogonal axes $P_1$, $P_2$ and $P_3$ represent three independent coin characteristics to be measured. For a coin of type A, the measurement of characteristic $P_1$ is expected to fall within a range (or window) $W_{A1}$, which lies within the upper and lower limits $U_{A1}$ and $L_{A1}$. Similarly, the characteristics or properties $P_2$ and $P_3$ of the coin are expected to lie within the ranges $W_{A2}$ and $W_{A3}$, respectively. If all three measurements lie within these ranges or windows, the coin is deemed to be an acceptable coin of type A. Under these circumstances, the measurements for acceptable coins will lie within the three-dimensional acceptance region designated as $R_A$ in FIG. 3. A coin validator arranged to validate more than one type of coin would have different acceptance regions $R_B$, $R_C$, etc., for different coin types B, C, etc.

Figure 7A:
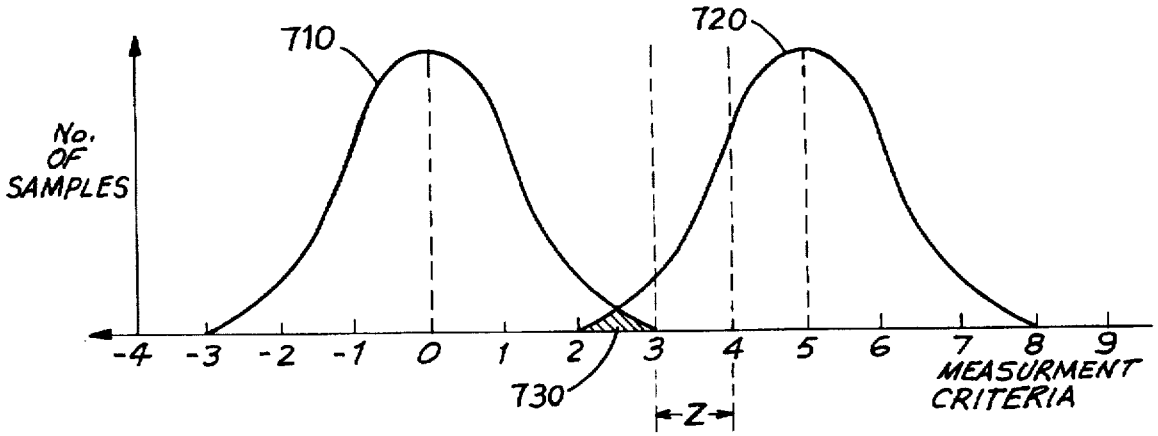
FIG. 7A is a graphical representation of the line distribution for the genuine coin criteria of FIG. 6 drawn to include a line distribution for the same criteria of an invalid coin, to illustrate the anti-fraud or anti-cheat aspect of the present invention.

As discussed further in connection with FIGS. 7B, 7C and 7D below, counterfeit coins or slugs may have sensor measurement distributions which fall within or overlap those for a genuine coin. For example, a slug may have characteristics which fall within region $R_A$ of FIG. 3 because the slug exhibits properties which overlap those of a valid coin of that denomination. Although tighter limits on the acceptance region $R_A$ may screen out such slugs, such a restriction will also increase the rejection of genuine coins.

The present invention, in order to provide improved coin acceptance criteria which are better defined, takes into account two observations concerning the vast majority of counterfeit coins. First, counterfeit coins do not produce the same distribution of sensor responses as do valid coins. Second, most counterfeit coins falling within an acceptance region, such as region $R_A$ shown in FIG. 3, were on the periphery of the acceptance region and exhibited very little overlap with the values found for genuine coins. See, e.g., the histograms designated as FIGS. 7B, 7C and 7D, which show the overlap for three separate coin tests, between a large set of empirically tested United States twenty-five cents coins and a large set of empirically tested foreign coins. The coin measurement criteria are represented on the abscissa of each histogram; the percentage of tested coins having specified measurement criteria may be determined from the ordinate of each histogram. It is noted that there is very little overlap on FIGS. 7C and 7D.

Figure 7B:
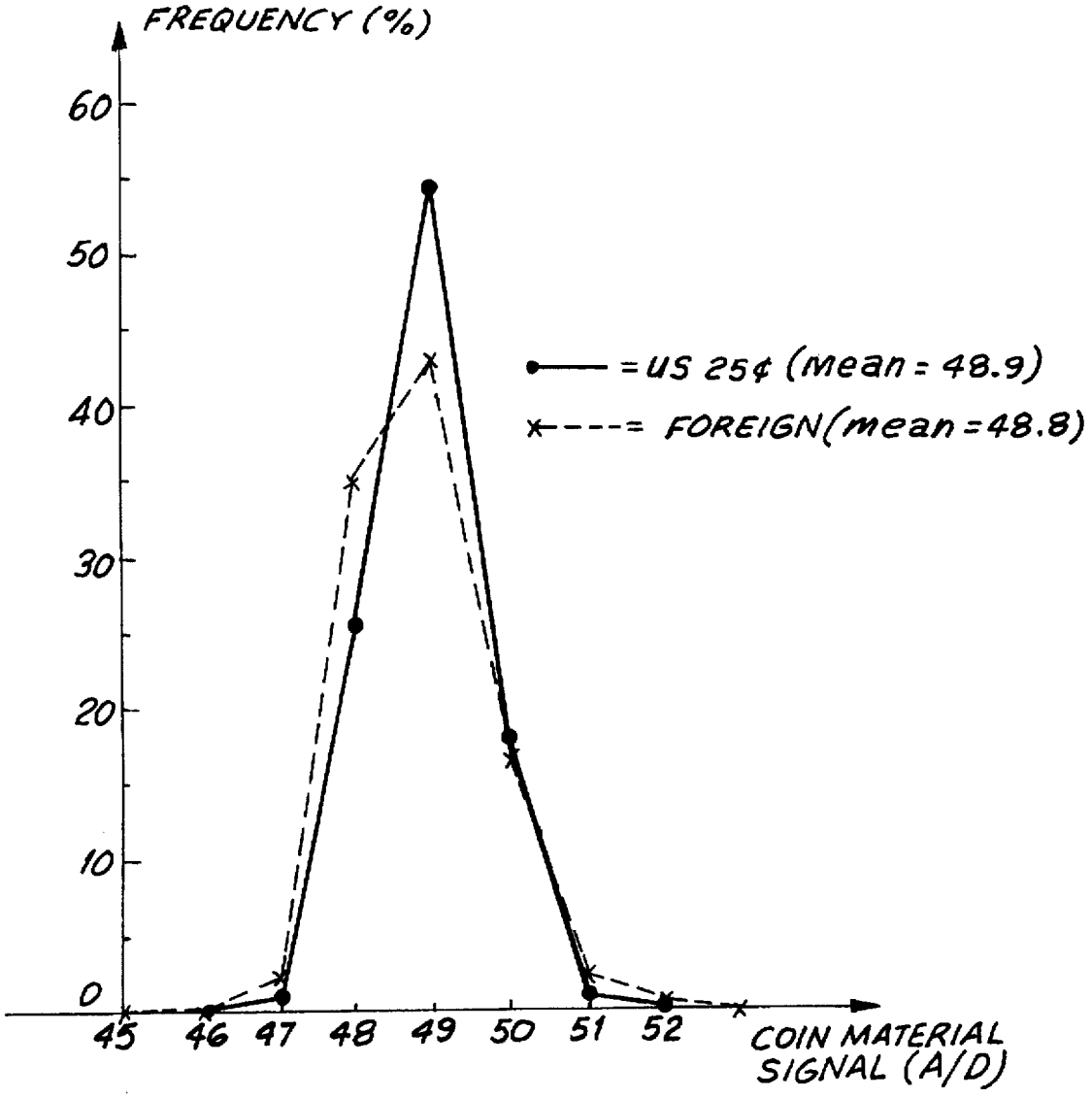
FIG. 7B is an additional graphical representation showing substantial overlap for certain measured criteria of a genuine coin line distribution and an invalid coin line distribution.
Figure 7C:
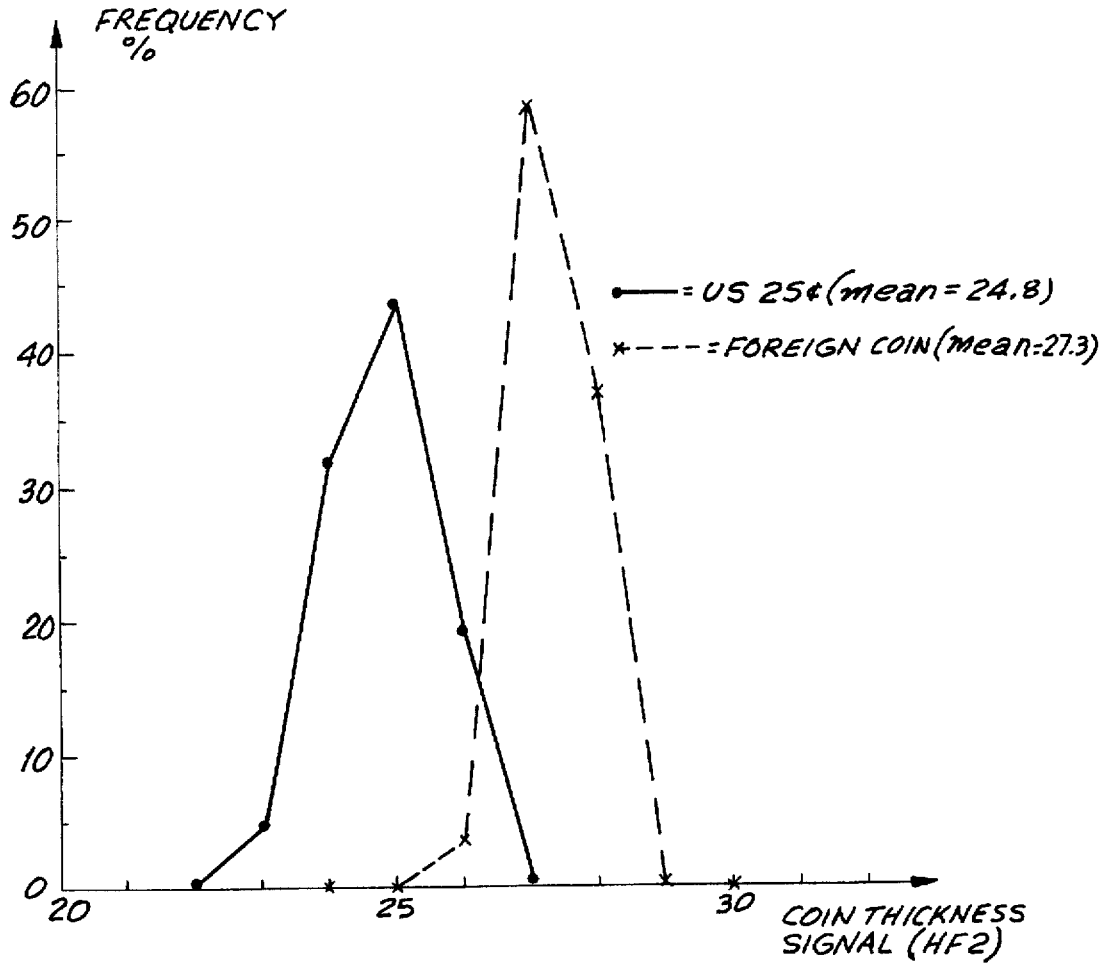
FIGS. 7C and 7D are additional graphical representations showing minimal overlap for certain measured criteria for certain genuine coin line distributions and invalid coin line distributions.
Figure 7D:
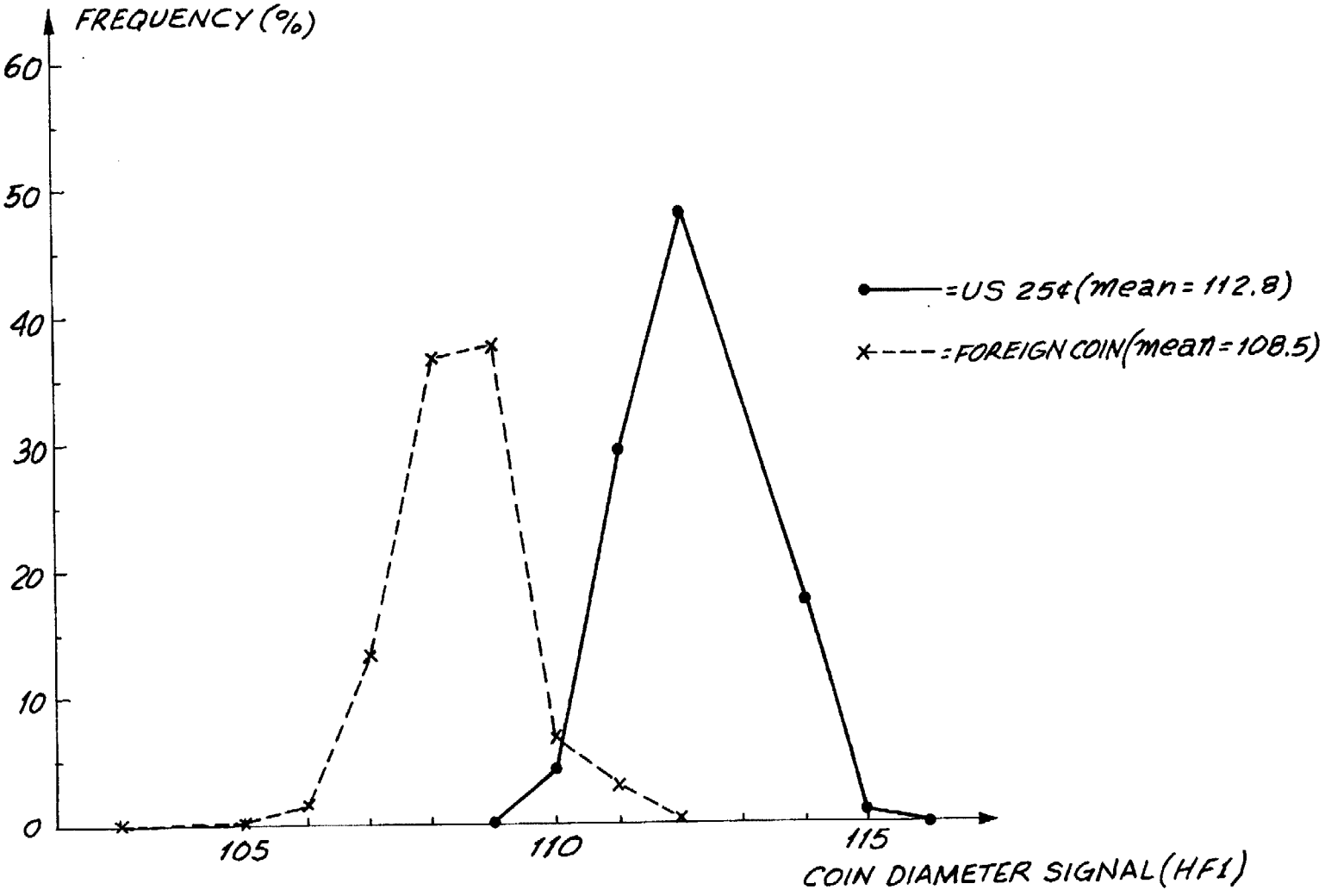

Looking at FIG. 7B, it is seen that the data for the twenty-five cents coins significantly overlaps the data for the foreign coin for the material test illustrated in this figure. No adjustment of this test criteria can practically reduce the acceptance of the foreign coin without also rejecting the vast majority of genuine twenty-five cents coins. On the other hand, for the thickness and diameter tests of FIGS. 7C and 7D, the areas of overlap are much smaller and individual adjustments of the acceptance criteria could be made that would significantly increase the rejection of the foreign coin while still accepting a large number of genuine twenty-five cents coins. In its presently preferred embodiment, the present invention takes a more subtle approach than just described in that it recognizes that coin acceptance criteria such as material, thickness, diameter and the like are generally not independent of one another. For example, a slug which has coin thickness which overlaps that typical of a genuine coin may be much more statistically likely to have a coin diameter that also overlaps that typical of a genuine coin. The present invention takes into account such interrelationships as further described below.

For a particular denomination coin, sensor response data from several different sets of sensors and for a large population of genuine coins was collected. One such distribution is illustrated in FIGS. 7B, 7C and 7D, which show the peak change in sensor response for a large number of representative twenty-five cents coins submitted through a coin mechanism in a normal manner. All this data was then mapped into a three dimensional coordinate system to form a "cluster" of acceptance values. Likewise, data was collected and mapped for known counterfeit coins or slugs. The data for one such foreign coin often used as a slug is also illustrated in FIGS. 7B, 7C and 7D. This data was similarly napped into a three dimensional coordinate system, and certain points were ruled out as acceptance points.

Figure 4:
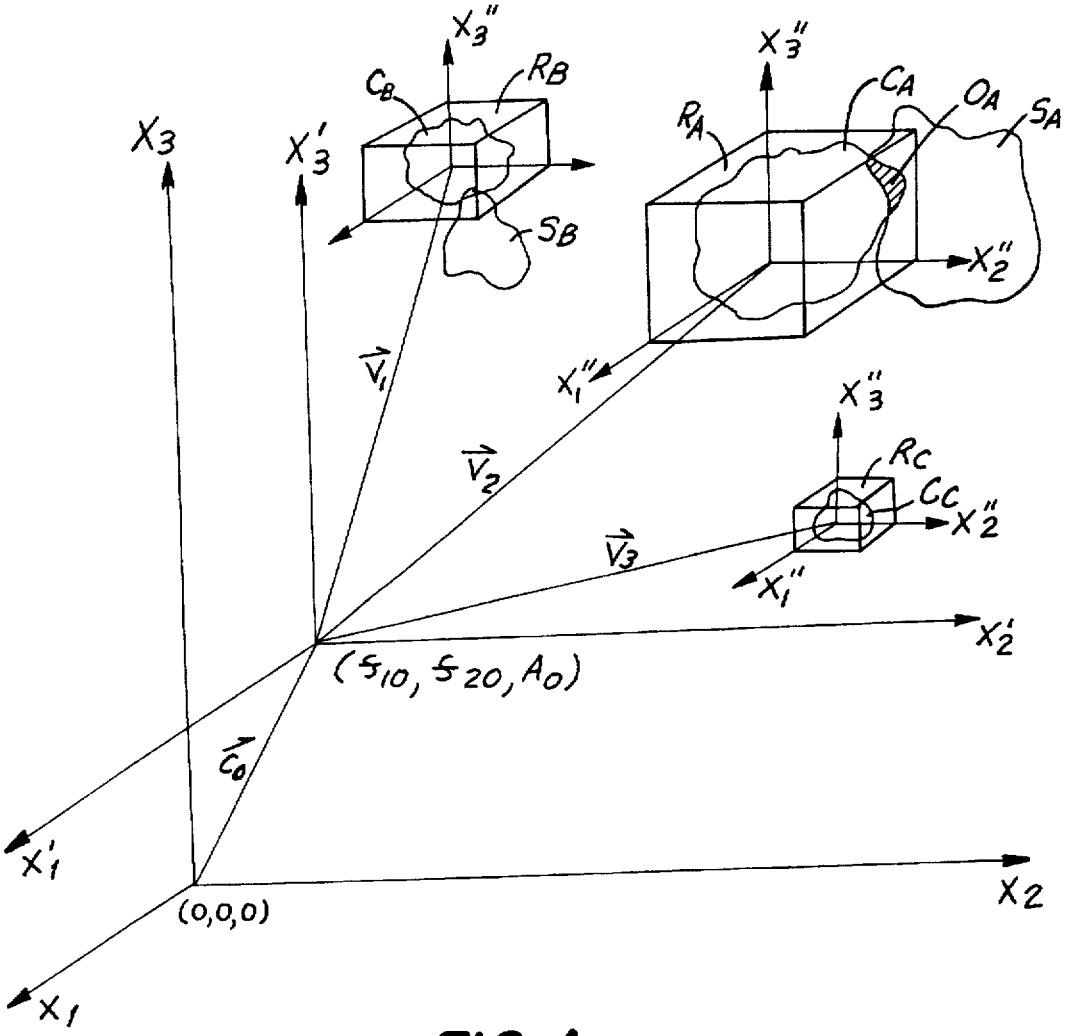
FIG. 4 is a graphical representation of one aspect of the present invention, namely improved coin acceptance criteria using coin acceptance clusters.

FIG. 4 represents a mapping of coin sensor values in a three dimensional coordinate system. The point 0.0.0 at the intersection of the $X_1$, $X_2$, $X_3$ coordinate axes ("x coordinate system") represents the point of zero electrical activity for the sensing circuits, while the point $f_{10}$, $f_{20}$, $A_0$ represents an idle operating point for the system. The point $f_{10}$, $f_{20}$, $A_0$ is an arbitrary starting point shown for exemplary purposes only and can be changed in response to environmental factors or the like. A vector $C_0$ terminates at this steady state idle operating point, and is utilized to perform a mapping from the x coordinate system, or the zero electrical activity system, to an x' coordinate system, the idle sensor response coordinate system.

Figure 3:
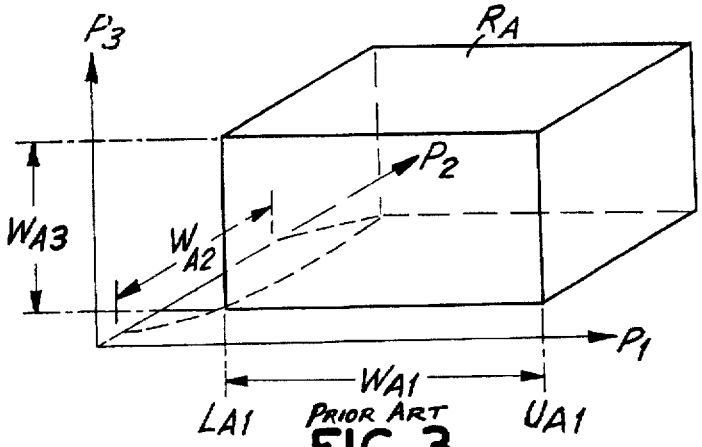
PRIOR ART FIG.3
FIG. 3 is a graphical representation of a prior art coin acceptance window for testing three coin acceptance criteria.

The regions $R_A$, $R_B$, and $R_C$ represent linear acceptance regions such as shown in FIG. 3 for use in detecting genuine coins of three differing denominations, while the regions $C_A$, $C_B$ and $C_C$ represent cluster regions for these same three genuine coins. Regions $S_A$ and $S_B$ are examples of counterfeit coin cluster regions. Vectors $V_1$, $V_2$ and $V_3$, which originate from the origin of the x' coordinate system, terminate at the genuine coin cluster centers for the sensor response distributions for each of the coin denominations, in effect napping from the x' system to x" systems for each of the coin clusters. This additional napping to the x" coordinate system saves on memory requirements and computation time for the microprocessor. Additional beneficial effects of this mapping approach are discussed below.

Coin clusters are formed and optimized for two sets of criteria. First, a mean vector for each coin type, represented by vectors $V_1$, $V_2$ and $V_3$ in FIG. 4, is created. These vectors are determined based on empirical statistical data for each coin. Once these vectors are determined, increased flexibility in acceptance criteria can be accomplished by allowing and increasing "tolerance" for the location of each vector. Typically, a tolerance of plus and minus one count for each vector is needed to maintain acceptance rates greater than 90%. The cluster center can also be offset by a tolerance of plus or minus two count permutations from its true position, and augmented again to achieve a higher acceptance rate of genuine coins.

The second criteria is to minimize slug acceptance. The goal of attaining the required slug rejection rate is addressed by removing the portion of the augmented coin cluster that overlaps the cluster region of a slug or slugs. An example of a portion that would be removed is shaded portion $O_A$ in FIG. 4. This portion $O_A$ has a very low frequency of occurrence for valid coins, and thus its removal minimally affects the coin acceptance rate. In the presently preferred embodiment, the resulting coin acceptance cluster is represented by points in a three dimensional space stored in a look-up table in memory.

Figure 5:
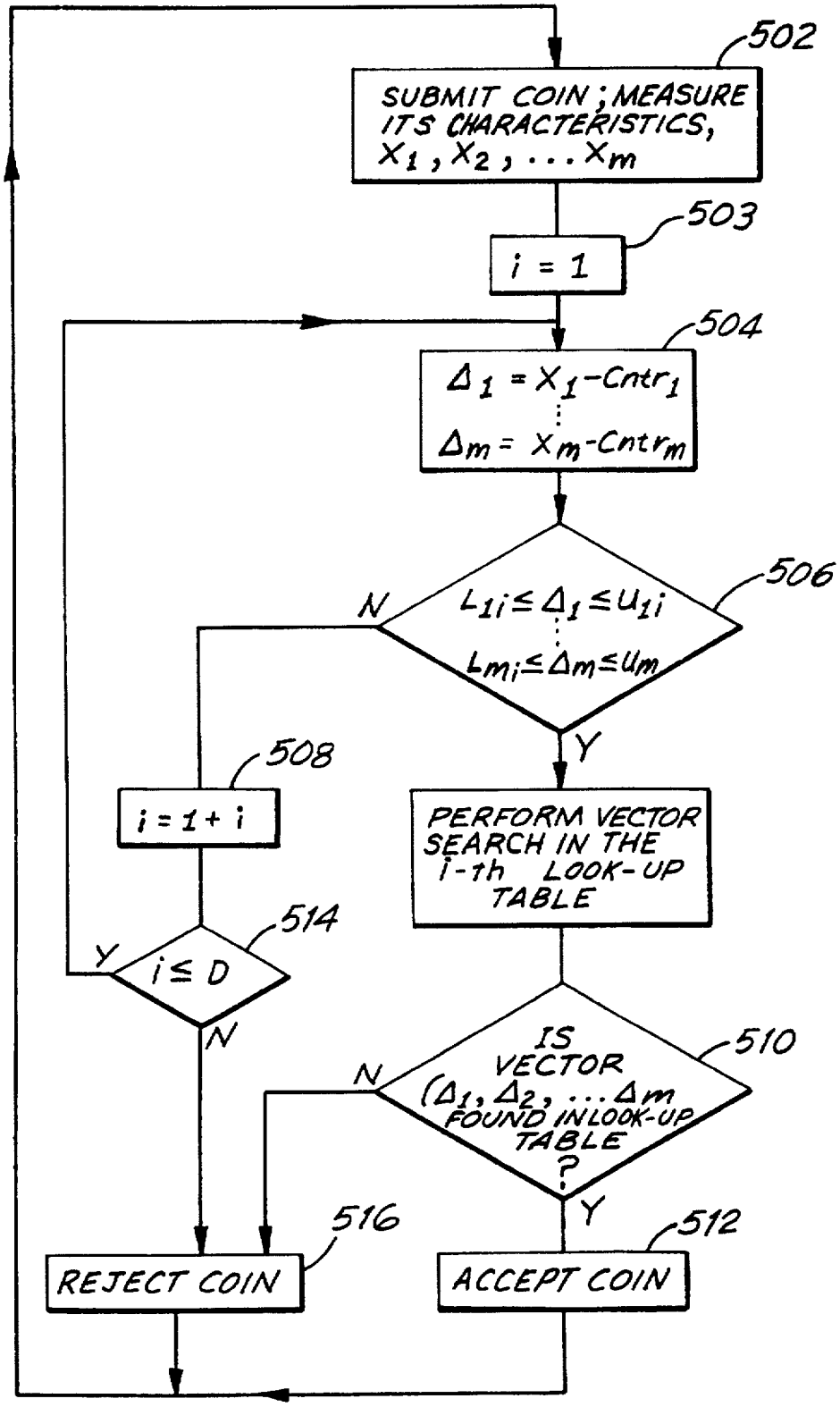
FIG. 5 is a flow chart of the operation of the coin acceptance clusters for the improved definition of coin acceptance criteria of the present invention.

FIG. 5 is a flow chart showing the operation of this aspect of the invention. For an initial coin denomination identification i=1 (block 503), the differences ($\Delta_1, \ldots \Delta_m$) between the measured characteristics of the coins ($X_1, \ldots X_m$) (block 502) and the respective center point for each vector ($Cntr_1, \ldots Cntr_m$) (block 504) are compared against upper and lower limits (block 506). In terms of the variable used on FIG. 5, i is the coin denomination index, m is the number of measured coin parameters, ($L_{1i}, \ldots L_{mi}$) are the lower limits and ($U_{1i}, \ldots U_{mi}$) are the upper limits.

If the Δ values do not fall within the appropriate limits, then the coin denomination index i is incremented (block 508) and the Δ values are compared against the limits for another coin denomination. When the Δ values are within the limits, the system checks to see if the vector formed by the Δ values is in the look up table (block 510); if the vector is in the table, then the coin is accepted (block 512). The coin denomination variable will be incremented until valid data is determined or until all valid denomination values have been searched (blocks 514, 516). Each time the coin denomination index "i" is incremented, the system looks to that portion of the look-up table relating to that coin denomination.

In this manner a specific level of coin acceptance is achieved while maintaining a high level of slug rejection. Further, the method and apparatus of the present invention attains the rejection of slugs that produce sensor responses that are not distinguishable from those of genuine coins following an approach as illustrated in FIG. 3.

A further advantage stems from the fact that the points defining the clusters may be represented as vectors whose components are all integer numbers and the cluster volume is a finite set of integer values. Sensor response measurements are taken relative to the x' coordinate system allowing the use of a smaller set of numbers than if the measurements were taken relative to the x coordinate system. In addition, the V vectors map the x' coordinate system to the x" coordinate system. If the mean is again removed from each measurement, then an even smaller set of integer numbers is needed to represent the cluster volume. Consequently, a canonical code may represent the cluster volumes. Representation of the coin clusters by canonical codes makes practical the use of low cost microprocessors having limited memory space, in that the specific function for each cluster can be easily stored in memory in a look-up table.

Further, a large degree of commonality was found to exist between clusters of different coin types relative to the x" coordinate system. This commonality permits the large common portion of cluster information for all coins to be stored only once, and the remaining coin specific values to be stored separately in microprocessor memory. Consequently, a savings in memory requirements is realized.

In the preferred embodiment, the look-up table is stored in memory in a sorted fashion in order to permit a fast search through the table. The search starts in the middle of the table, and uses a search technique for fast identification of the portions of the table which contain the data of interest.

It should be noted that in order to stabilize the measurements and maintain a high degree of genuine coin acceptance with varying environmental changes, historical information for each of the $C_0$ and V vectors must be maintained, and these vectors must also be varied when system parameters change due to temperature, humidity, component wear and the like. These vectors point to the idle operating state of the system and are functions of parameters which may experience step changes as well as slow variations, all of which require compensation and adaptive tracking to provide a stable operating platform. Also, while the V vectors for all coin types are compensated in exactly the same manner, they can also be compensated as a function of coin denomination.

It should also be noted that the coin acceptance cluster may be created in two dimensions rather than three, based on measurement of two coin characteristics rather than three.

ANTI-FRAUD AND ANTI-CHEAT

Another aspect of the present invention involves an improved method and apparatus for avoiding a fraud practice where slugs have been used in a prior art coin validator in an attempt to move the acceptance window toward the slug distribution. The prior art method may be understood by taking all f variables representing any function which might be tested, such as frequency, amplitude and the like, for any coin test. The specific discussion of the prior art which follows will be in terms of frequency testing for United States 5-cent coins using circuitry as shown in FIG. 1 programmed to operate as described below.

For initial calibration and tuning, a number of acceptable coins, such as eight acceptable 5-cent coins, are inserted to tune the apparatus for 5 cent-coins. The frequency of the output of sensor circuit 21 is repetitively sampled and the frequency values $f_{measured}$ are obtained. A maximum difference value, Δf, is computed from the maximum difference between $f_{measured}$ and $f_0$ during passage of the first 5-cent coin. $\Delta f=\max(f_{measured}-f_0)$.

Next, a dimensionless quantity, F, is calculated by dividing the maximum difference value Δf by $f_0$ where $F=(\Delta f/f_0)$. The computed F for the first 5-cent coin is compared with the stored acceptance limits to see if it lies within those limits. Since the first 5-cent coin is an acceptable 5-cent coin, its F value is within the limits. The first 5-cent coin is accepted and microprocessor 35 obtains a coin count C for that coin.

The coin count C is incremented by one every time an acceptable coin is encountered until it reaches a predetermined threshold number. Until that threshold number is reached, new F values are stored based on the last coin accepted. When that threshold number is reached, a flag is set in the software program to use the latest F value as the center point to determine the acceptance limits of the acceptance "window" for subsequently inserted coins. The originally stored limits are no longer used, and the new limits may be based on the latest F value plus or minus a constant, or computed from the latest F value in any logical manner. Once the apparatus is tuned as discussed above, it is capable of performing in an actual operating environment.

The coin mechanism was designed to continually recompute new F values and acceptance limits as additional coins were inserted. If a counterfeit coin was inserted, its F value theoretically would not be within the acceptance limits so the coin would be rejected. After rejection of a counterfeit coin a new idling frequency, $f_0$, was measured and then the microprocessor 35 awaited the next coin arrival.

Recomputation of the F values and acceptance limits in this manner allowed the system to self-tune and recalibrate itself and thus to compensate for component drift, temperature changes, other environmental shifts and the like. In order for beneficial compensation to be achieved, the computation of new F values was done so that these values were not overly weighted by previously accepted coins.

While achieving many benefits, the prior art system has suffered because in practice a slug exists whose measured characteristics overlap those for a known acceptable coin as illustrated in FIG. 7A. In FIG. 7A, the item designated 710 is a line distribution for certain measurement criteria of a genuine coin. Curve 720 is a line distribution for the same measurement criteria of a slug. The overlap is shown as the shaded area 730 in FIG. 7A. As a result, the repeated insertion of these slugs will move the window center point toward the slug by tracking as those slugs are accepted. Eventually, acceptance will be 100% for the slug and poor for the valid coin.

The present invention addresses this problem as discussed below.

Figure 6:
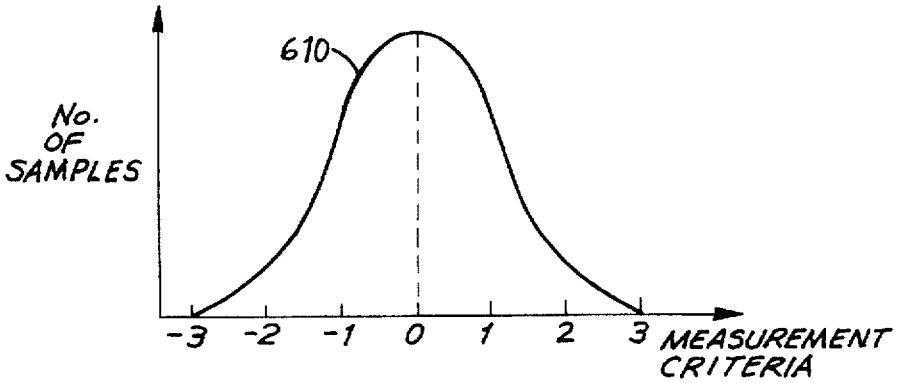
FIG. 6 is a graphical representation of a typical line distribution curve of certain measured criteria for a genuine coin.

Acceptance criteria for any given denomination coin may be illustrated by the measured distribution of coin test data from the center point of a coin acceptance window. In the preferred embodiment of the present invention, as discussed earlier in this application, the dimensionless quantity F is computed and then compared with stored acceptance limits to see if the computed value of F for the coin being tested lies within a certain distribution in the coin acceptance window. FIG. 6 is a representation of such a distribution having a center point at zero and acceptance limits at "+3" and "−3". Item 610 in FIG. 6 represents a measured criteria line distribution for a genuine coin.

In practice, invalid coins have distributions that slightly overlap those of genuine coins. Item 710 in FIG. 7A depicts the genuine coin line distribution of FIG. 6 having a center point at "0", and the overlapping line distribution of an invalid coin or slug having a center point at "5". The invalid coin line distribution is designated as 720. Of course, there are distributions for invalid coins other than that shown in FIG. 7A, including distributions to the left of the genuine coin distribution 710. The genuine coin distribution and the invalid coin distribution shown in FIGS. 6 and 7A are exemplary only.

It is readily seen that the line distribution of characteristic data for the genuine coin overlaps with the line distribution for the invalid coin in the shaded area 730 shown in FIG. 7A. For a coin mechanism employing window self-adjustment, such as that described above with respect to the prior art, repeated insertion of invalid coins, some of which have characteristics just within the outer edges of the genuine coin acceptance window, will cause the system to move the center point of the coin acceptance window toward the distribution pattern of the invalid coin. This "tracking" eventually results in acceptance of invalid coins and rejection of genuine coins. A person wishing to cheat or defraud the coin mechanism need only repeatedly insert a certain invalid coin into the coin mechanism, thereby in effect programming the system to accept non-genuine coins, resulting in a significant loss of revenue.

To combat such behavior, the present invention provides for improved invalid coin rejection by preventing this "tracking" of the center point of the acceptance window toward the invalid coin distribution. This is accomplished by sensing any invalid coin that has parameters which fall close to the outer limits of the coin acceptance window, such as within a "near Miss" area "z" in the invalid coin distribution between points "3" and "4" on the graph in FIG. 7A.

Figure 8:
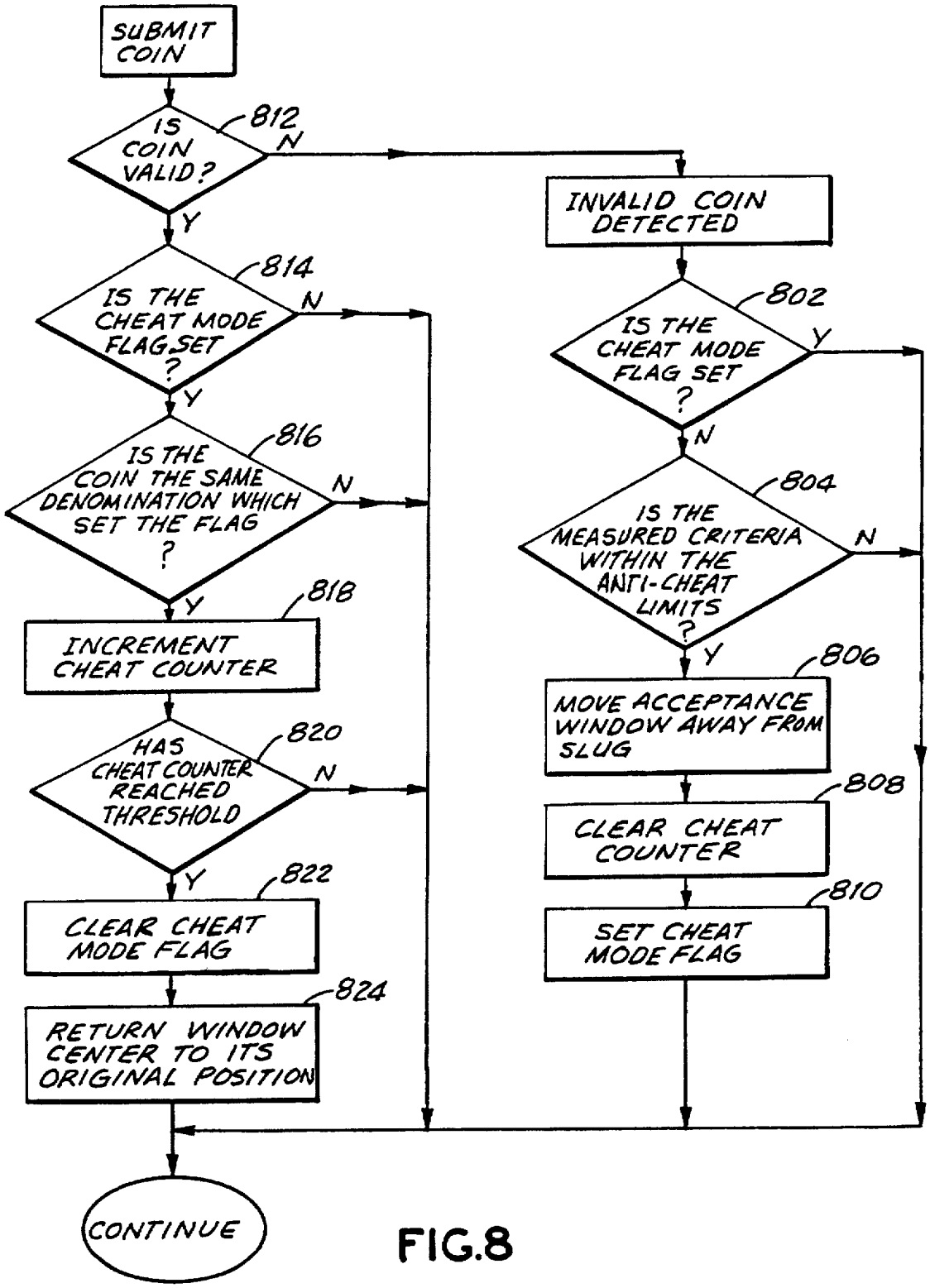
FIG. 8 is a flow chart of the operation of the anti-fraud or anti-cheat aspect of the present invention.

The sequence of steps followed for this method are set forth in the flow chart of FIG. 8. First, a determination is made whether a submitted coin is valid (block 812, FIG. 8). Coins having specified parameters within the genuine coin acceptance window, for example, as defined by symmetrical limits "+3" and "−3" around the center point "0" of the genuine coin distribution of FIGS. 6 and 7A, are considered valid; those coins outside of that coin acceptance window are considered not valid.

If the coin is not valid, the system determines whether the cheat mode flag is set (block 802). If that flag is not set, a determination is made whether the invalid coin fits within the "near miss" area, "z" between "3" and "4" on FIG. 7A (block 804). If the answer to that inquiry is yes, the system moves the center of the coin acceptance window a preset amount away from the invalid coin distribution curve (block 806). For example, with reference to FIG. 7A, the center of the coin acceptance window is moved from "0" to "−1". Alternatively, the right acceptance boundary may be moved from "3" to "2". In either case, very few genuine coins will not be accepted, but essentially all invalid coins will now be rejected, thereby preventing any attempted fraud.

A cheat counter is then cleared (block 808), and the cheat mode flag is set (block 810). If another invalid coin is then inserted into the mechanism, the system recognizes that the cheat mode flag is set (block 802), and no changes are made to the center position of the coin acceptance window.

With regard to the FIG. 7A example, the center of the coin acceptance window is maintained at its "−1" position until a preset, threshold number of valid coins of the same denomination are counted in the cheat counter. The cheat counter can be reset to zero if another invalid coin is submitted to the mechanism which has a characteristic which fits within the "near miss" area "z" on FIG. 7A.

Once the cheat counter reaches the desired threshold number, the cheat node flag is cleared and the center of the coin acceptance window is moved back to its original position. These steps are shown on the FIG. 8 flowchart, in the left-hand column, blocks 812 to 824.

Specifically, after block 812 determines that the coin is valid, block 814 recognizes that the cheat mode flag is set. If the valid coin is the same denomination as what triggered the cheat mode flag (block 816), then the cheat counter is incremented (block 818). When the cheat counter reaches its preset threshold limit (block 820), the cheat mode flag is cleared (block 822), and the acceptance window is returned to its original position (block 824).

In the FIG. 7A example, the center of the coin acceptance window is moved from "−1" back to "0" once the threshold number of valid coins is counted in the cheat counter.

By this method, attempts to train the coin mechanism to accept counterfeit coins, slugs and the like are thwarted, in that the center of the coin acceptance window will not move toward the invalid coin distribution if the user repeatedly inserts a number of the invalid coins into the coin mechanism, even though some of these coins would normally be acceptable and some would only miss being acceptable by a small amount such that a slight movement of the acceptance criteria would result in their acceptance. In fact, according to this aspect of the present invention, the coin acceptance window moves away from the invalid coin distribution for certain non-valid coins or slugs, until such time as a threshold number of valid coins are counted.

The above described method can be used for any denomination coins. Further, the value of various parameters is adjustable, including but not limited to the threshold value of genuine coins required to clear the cheat mode flag, the width of that portion of the invalid coin distribution which triggers the cheat mode (area "z" in FIG. 7A), and the distance that the center of the coin acceptance window is moved away from the invalid coin distribution. These and other parameters may be customized for each denomination coin and any other special conditions relating to the coin mechanism or the coins. For example, if it is known that a counterfeit coin having a certain distribution is often mistaken for a genuine U.S. twenty-five cents coin, then the acceptance window for this coin can be programmed to move a distance cut of the range of that counterfeit coin and to stay there for a minimum of 10 or more genuine U.S. quarter coin validations.

This anti-fraud and anti-cheat method and apparatus may be used independently of the other aspects of this invention in any coin testing apparatus in which the coin criteria can be adjusted by the control logic which controls the coin, bill or other currency test apparatus. However, the presently preferred embodiment is to incorporate this anti-fraud, anti-cheat aspect in conjunction with the other aspects of the present invention in one system.

IMPROVED COIN ACCEPTANCE WINDOW CENTER SELF-ADJUSTMENT

A method for self-adjustment of the center of the coin acceptance window involves accumulating a sum of the deviations from the center of the coin acceptance window for each coin. When the sum of deviations equals or exceeds a pre-set value, the center position of the coin acceptance window is adjusted.

By one aspect of the present invention, only small or gradual deviations from the center point of the coin acceptance window are added to the running sum of deviations. Abrupt or large deviations in the coin variables outside of this small deviation band are ignored in terms of center adjustment, as it is recognized that adjustment based on such large deviations tends to unduly shift the coin acceptance windows toward the acceptance of counterfeit coins, slugs and the like, and away from acceptance of genuine coins.

Figure 9:
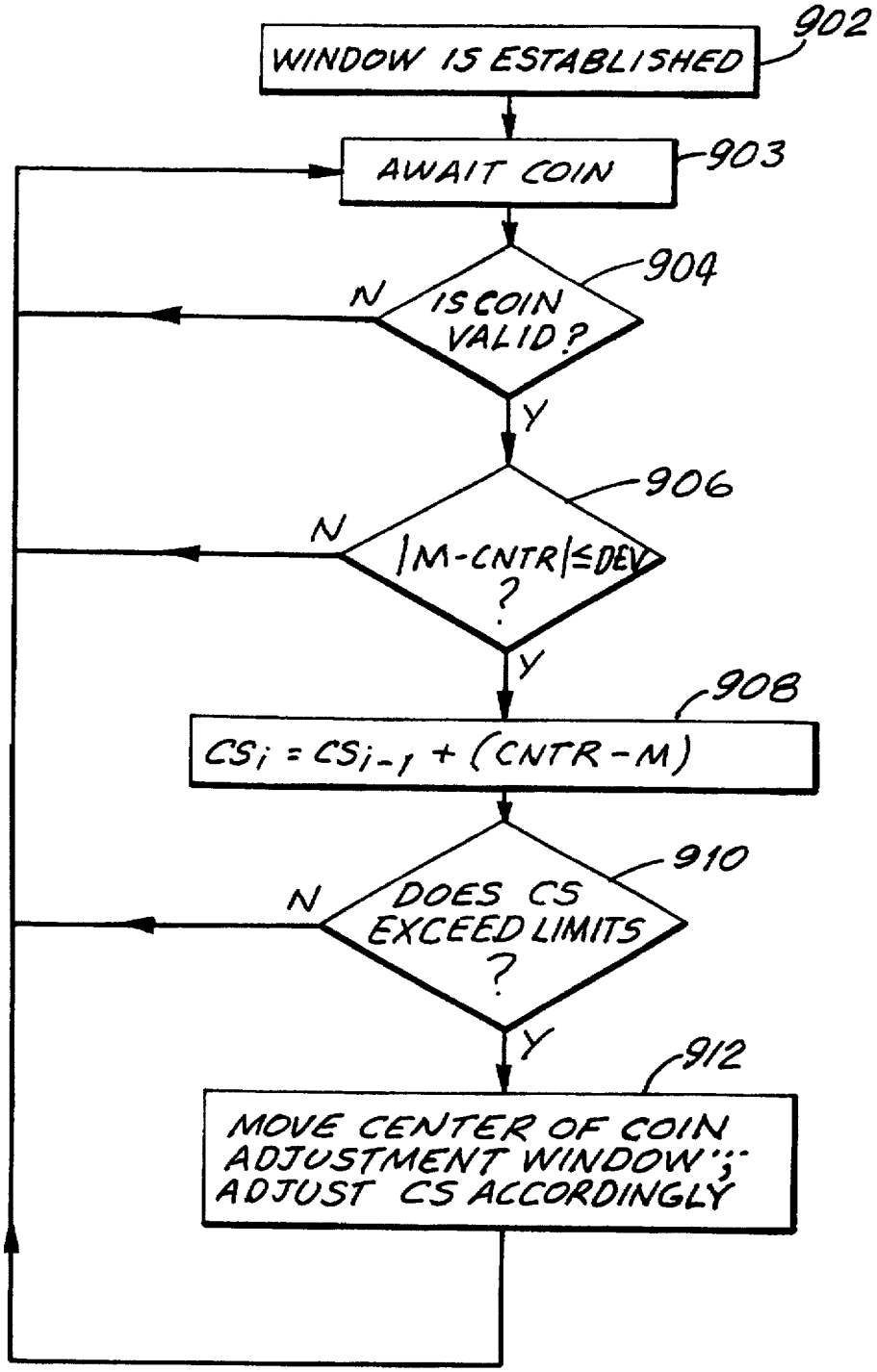
FIG. 9 is a flow chart of the operation of the aspect of the present invention relating to minimizing the effects of counterfeit coins and slugs on the self-adjustment process for the center of the coin acceptance window.

FIG. 9 is a flow chart showing the steps involved in this aspect of the present invention. First, the coin mechanism is "taught" in the usual manner, e.g., utilizing 8 valid coins to establish the necessary information concerning the coin acceptance window. Outside limits are then set for the window in any one of a number of conventional manners or using the cluster technique described above. These steps are combined in block 902, which states that the window is established. If the coin is not accepted as valid (block 904), no adjustment to the center of the coin adjustment window (designated in FIG. 9 as CNTR) is made and the system waits for the next coin (block 903).

If the coin is determined to be valid (block 904), then the absolute value difference between M, the measured criteria for that particular coin, and CNTR is compared to the center adjustment deviation limit DEV (block 906). If this absolute value difference is less than the limit DEV, then the cumulative sum value CS is modified by adding to it the value "CNTR−M" (block 908).

If the absolute value difference between M and CNTR exceeds the limit DEV (block 906), then no adjustment is made to the cumulative sum CS, and the system awaits arrival of the next coin.

When the cumulative sum CS equals or exceeds a certain positive cumulative sum limit, or is equal to or less than a negative cumulative sum limit (block 910), the value of CNTR is incremented by a preset amount or is decremented by a preset amount, as appropriate (block 912). The cumulative sum CS is then adjusted accordingly, and the system awaits the arrival the next coin.

Thus, it is seen that only valid coins having small deviations from the center value CNTR of the coin adjustment window affect the self-adjustment of that center value. Coins which deviate outside this limited deviation range do not effect the center self-adjustment. Since counterfeit coins and slugs will almost in all cases deviate from the center point CNTR more than the limit DEV amount, this method virtually insures that counterfeit coins, slugs and the like will not affect the center self-adjust mechanism.

The method for protecting the center self-adjustment mechanism described above allows a wider coin acceptance window to be utilized, thereby increasing the frequency that genuine coins will be accepted by the system.

In the preferred embodiment, this improved coin acceptance window center self-adjustment is utilized in combination with all other aspects of the present invention. However, it is to be understood that this center-adjust method may be used independently of, or in various combinations with, the aspects of the present invention.

RELATIVE VALUE COMPUTATION

It is beneficial to employ a low-cost microprocessor to calculate the dimensionless F value discussed above, which may also be referred to as the relative value. To this end, in order to perform calculations based upon the F value, a scaling factor of 256 was utilized to ease processing, and the resulting number was truncated to the nearest integer.

This method of calculation resulted in some loss of resolution. For example, when the ratio of the scaling factor of 256 and the rest value $f_0$ was greater than one, not all integer values existed within the range covered by the relative values F for a certain rest value $f_0$. For example, if the rest value $f_0$ was 128 KHz, then the relative value F would be even numbers. ($F=\Delta f/128*256=\Delta f*2$). Similarly, only odd values of F existed if $f_0$ was an odd number. Further, when the rest value $f_0$ changed, the list of non-existing values changed also. Consequently, an expanded look-up table was required in order to accomodate all possible relative values F. This consumed expensive memory space, and increased the computation time spent for coin validation.

Also, use of such a high scaling factor as 256 meant that oftentimes the integer value of F was much greater than unity, and therefore extra memory space was required to store the necessary data for the F value, the center of the coin acceptance window and the limits of that window.

Further, for sensors operating at high frequencies, validation resolution was lost, as one integer relative value F represented several possible actual shift values $\Delta f$, due to truncation. For example, if a sensor operated at $f_0=1024$ KHz, then 256 divided by 1024 equals ¼, which became the multiplier for the shift value $\Delta f$. In this example, for $\Delta f$ values of 4, 5, 6 and 7 KHz, at $f_0=1024$ KHz, F=1 for all four $\Delta f$ values. This resulted in a loss in resolution which reduced the ability of the coin mechanism to separate counterfeit from genuine coins.

Lastly, in the prior art systems, truncation of the calculation of the F relative value resulted in a 0.5 bias of the center of the coin adjustment window. This is because all values between integers were truncated downward. Since window centers could only be adjusted in increments of plus or minus one, the center was always biased by plus or minus 0.5 in steady state. This further reduced the coin acceptance rate. If a plus or minus one expansion of the window width was used to compensate for the reduced coin acceptance rate, the result was increased acceptance of counterfeit coins.

Another aspect of the present invention, described below, provides additional resolution over the usage in the prior art systems of the 256 scaling factor. The relative value F is now preferably calculated according to the following equation: $F=\Delta f * E(f_0)/f_0$, where $E(f_0)$ is the exponentially weighted moving average (also referred herein to as the EWMA) of the rest value ($f_0$) calculated for each variable and coin denomination separately. The theoretical equation for the exponentially weighted moving average at coin increment is:

$$E(f_0)_i=E(f_0)_{i-1}+W*(f_{0i}-E(f_0)_{i-1})+0.5 \qquad \text{EQUATION A}$$

where W=weighing factor, and has a value between 0 and 1. The result is rounded as opposed to truncated to eliminate the 0.5 bias error. For the first validation measurement, $E(f_0)$ is set to equal $f_0$ where $f_0$ is the rest value during the "teaching" of the unit, as that teaching is described earlier in this application. Through computer simulation, it has been determined that a value for W of 1/40 results in the best performance of the coin mechanism. Over time, the ratio of $E(f_0)_i/f_{0i}$ approaches unity in the steady state of $f_0$.

The ratio of the exponentially weighted moving average ($E(f_0)_i$) and the instantaneous rest value ($f_{0i}$) will have moderate deviations from unity, with larger deviations being rare. On those occasions when an abrupt change of the rest value $f_0$ occurs, the ratio of $E(f_0)_i/f_0$ may significantly deviate from unity, partially compensating for the shift value $\Delta f$ change. This makes it possible for window center self-adjustment without a significant expansion of the window. Further, while the window is being self-adjusted the ratio of the $E(f_0)_i/f_{0i}$ gradually comes back to unity if no new perturbations occur for a large enough amount of submitted coins.

Figure 11:
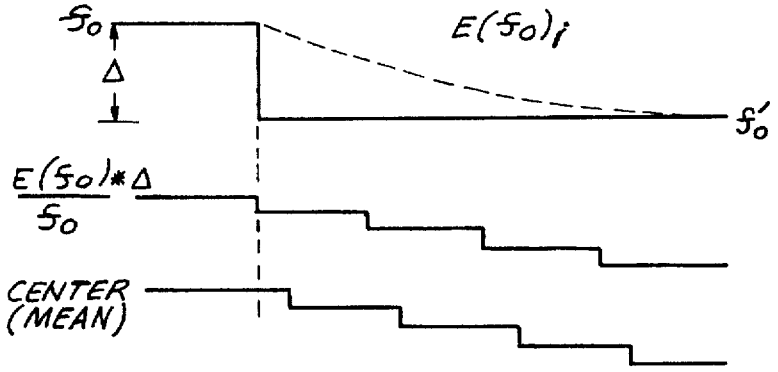
FIG. 11 is a graphical representation concerning that aspect of the present invention describing the modification of the measured response in the validation apparatus due to the presence of large changes to the reference parameter.

FIG. 11 shows a step change of the rest value $f_0$ to $f_0'$ and the curve of the exponentially weighted moving average $E(f_0)_i$ shown as a dotted line. Any step changes in rest values, $f_0$, that would easily throw the shift values $\Delta f$ outside the acceptance window must be compensated for by $E(f_0)$ to provide a smooth transition from one operating point to another. Referring to FIG. 11, this smooth transition should be at a rate that is slower than the tracking rate of the system. $E(f_0)/f_0$ allows the window center to track the shift value with some delay as shown in FIG. 11.

As long as the relative deviation of the rest value $f_0$ from its exponentially weighted moving average, multiplied by the shift value $\Delta f$, is within the range plus or minus 0.5, this aspect of the present invention does not create gaps between relative values F. This method provides for a sufficient coin acceptance rate allowing for fast self-adjustment of centers of coin acceptance windows following abrupt and large changes in rest values $f_0$ in most cases. Further, the new method produces relative values F having no loss of resolution and also eliminates the 0.5 bias by rounding, allowing for improved counterfeit coin rejection. Another advantage is ease of microprocessor implementation since the exponentially weighted moving average can be easily calculated. Current values of the exponentially weighted moving average need to be calculated separately for each rest value and stored, and only one constant value of W need be stored.

It should be noted that EQUATION A for the exponentially weighted moving average given above is just one example of an equation having the required characteristics. The required characteristics include that the ratio ($E(f_0)_i/f_{0i}$) must go to unity in steady state, and that during a transition in rest the ratio ($E(f_0)/f_0$) must be such that when multiplied by the shift value $\Delta f$, the relative value F must fall within the acceptance window, so that an adjustment of the center of the coin acceptance window can be made.

Figure 10:
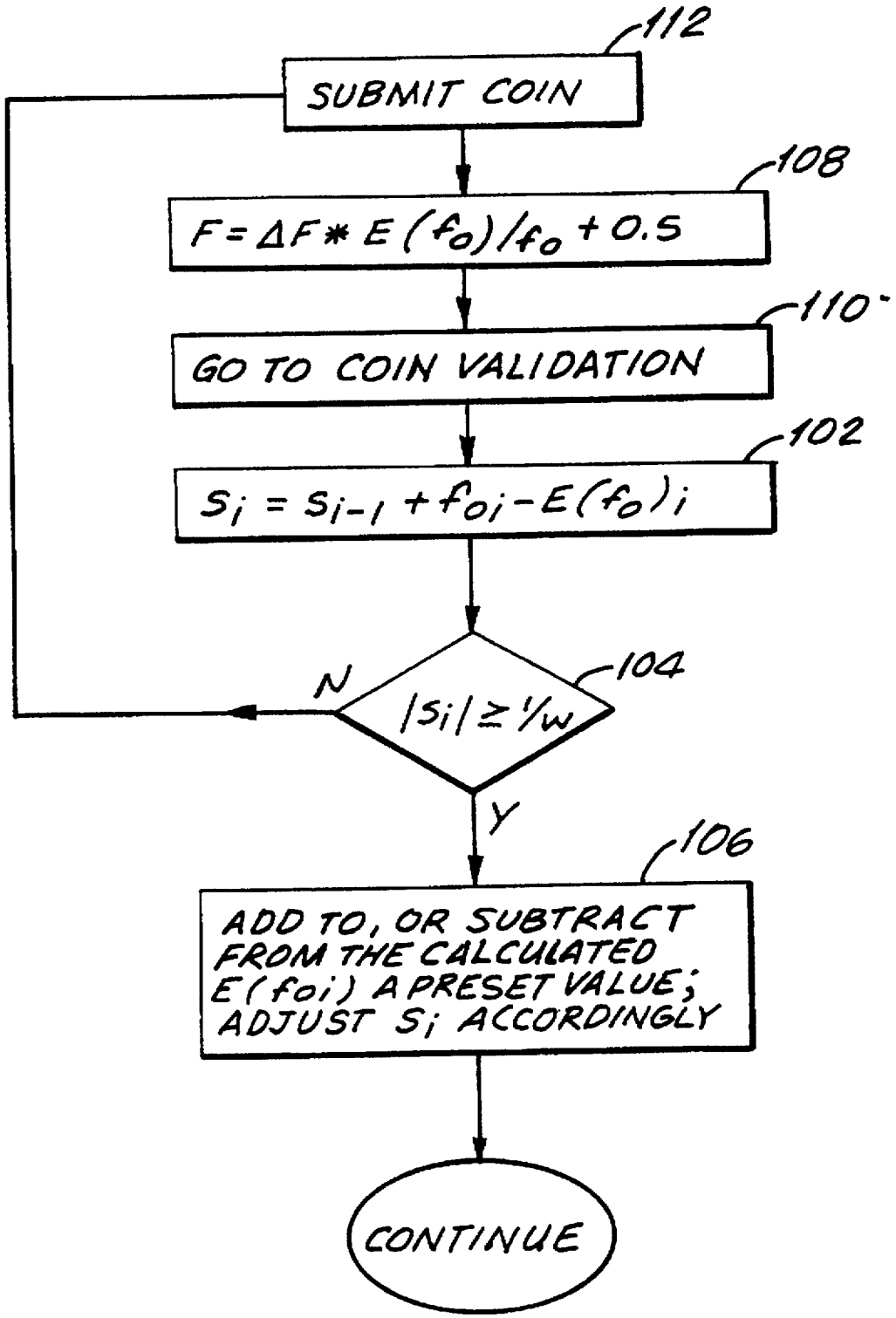
FIG. 10 is a flow chart of a portion of the operation of the present invention relating to relative value computation and conservation of memory space and minimization of microprocessor computation time in a microprocessor based coin validation system.

The exponentially weighted moving average (EWMA) can be calculated to compensate for various changes such as unit aging, wear, contamination and cleaning, ambient temperature, etc. This can be accomplished in the following manner, as shown in the flow chart of FIG. 10.

The initial EWMA ($E(f_0)$) equals the rest value $f_0$ at the time the mechanism is "taught". Deviations between the subsequently computed EWMA and the relevant rest value $f_{0i}$ are then summed (block 102, FIG. 10). When the absolute value of the sun of deviations ($S_i$) exceeds a threshold value 1/W (block 104), then the EWMA is incremented or decremented by a preset amount (depending on the sign of the deviation sun), and the deviation sum is adjusted accordingly (block 106). In the preferred embodiment, the EWMA is moved "+1" or "−1" when the sum of deviations exceeds the threshold value of 1/W. If the sum of deviations does not exceed the threshold, the system awaits arrival of the next coin (block 112).

In place of frequency, any parameter having a rest value (such as amplitude) may be used.

A further aspect of the present invention involves combining all of the above disclosed methods in one coin, bill or other currency validation apparatus. Of course, other combinations and permutations of the above aspects are also contemplated and may be found beneficial by those skilled in the art.

In the preferred embodiment, with regard to certain aspects of the present invention, the microprocessor 35 is programmed according to the attached printout appended hereto as an Appendix; however, the operation of the electronic coin testing apparatus 10 and the methods described herein, will be clear to one skilled in the art from the above discussion.

We claim:

1. A method of operating a money validation apparatus which utilizes an acceptance window to authenticate test items, comprising:

defining a deviation limit having a range of values surrounding a predefined point of the acceptance window;

generating at least one test signal in response to a test item;

accepting the test item if the test signal falls within the acceptance window;

incrementing a cumulative sum if the test signal is within the deviation limit and above the pre-defined point; and modifying the acceptance window if the cumulative sum exceeds a preset number.

2. The method of claim 1, further comprising:

decrementing the cumulative sum if the test signal is within the deviation limit and below the pre-defined point; and modifying the acceptance window if the cumulative sum reaches a predetermined number.

3. The method of claim 1, wherein the deviation limit range of values is small in comparison to the acceptance window.

4. A method of operating a money validation apparatus so that it is self-adjusting, wherein the apparatus produces at least one output signal in response to the presence of items of money, and accepts an item of money when the output signal falls within an acceptance window defined by a reference value and a boundary value, comprising:

setting a deviation limit window within the acceptance window near the reference value, wherein the deviation limit window is small in size in comparison to the acceptance window; and modifying the acceptance window if the output signal lies within the deviation limit window.

5. The method of claim 4 wherein the acceptance window is also defined by a second acceptance boundary and wherein the first and second acceptance boundaries are located about the reference value.

6. The method of claim 5, further comprising:

setting a second deviation limit window between the reference value and the second acceptance boundary; and modifying the acceptance window if the output signal lies between the reference value and the second deviation limit.

7. The method of claim 4 wherein the step of modifying the acceptance window comprises adjusting the reference value.

* * * * *